US010794087B2

(12) United States Patent
Teunis et al.

(10) Patent No.: US 10,794,087 B2
(45) Date of Patent: Oct. 6, 2020

(54) DOOR LOCKING DEVICE, IN PARTICULAR AN ELECTROMAGNETIC DOOR LOCKING DEVICE

(71) Applicant: Kendrion Kuhnke Automation GmbH, Malente (DE)

(72) Inventors: Bleik Teunis, Gettorf (DE); Borgar Pfeiffer, Schwentinental (DE); Wolfram Heisen, Lütjenburg (DE)

(73) Assignee: Kendrion Kuhnke Automation GmbH, Malente (DE)

( * ) Notice: Subject to any disclaimer, the term of this patent is extended or adjusted under 35 U.S.C. 154(b) by 523 days.

(21) Appl. No.: 15/453,314

(22) Filed: Mar. 8, 2017

(65) Prior Publication Data

US 2018/0202191 A1 Jul. 19, 2018

(30) Foreign Application Priority Data

Jan. 16, 2017 (EP) ..... 17151671

(51) Int. Cl.
*E05B 15/00* (2006.01)
*E05B 47/00* (2006.01)
*E05C 3/24* (2006.01)

(52) U.S. Cl.
CPC ..... *E05B 47/0002* (2013.01); *E05B 15/0086* (2013.01); *E05B 47/0001* (2013.01); *E05C 3/24* (2013.01); *E05B 2047/0069* (2013.01)

(58) Field of Classification Search
CPC ..... E05B 47/0002; E05B 15/0086; E05B 47/0001; E05B 2047/0069; E05C 3/24
See application file for complete search history.

(56) References Cited

U.S. PATENT DOCUMENTS 5,288,037 A * 2/1994 Derrien ..... B64C 25/26 244/102 SL
2001/0018379 A1* 8/2001 Sugita ..... B62M 7/02 474/111
2013/0320032 A1* 12/2013 Rahilly ..... E05B 47/0012 221/154

FOREIGN PATENT DOCUMENTS

DE 4031077 A1 4/1992
EP 0300480 A1 1/1989
EP 0300840 A1 * 1/1989 ..... E05B 77/26
EP 1489252 A2 12/2004

* cited by examiner

*Primary Examiner* — Kristina R Fulton
*Assistant Examiner* — Thomas L Neubauer
(74) *Attorney, Agent, or Firm* — Rankin, Hill & Clark LLP

(57) ABSTRACT

A door locking device, in particular an electromagnetic door locking device, for a door with a rotary catch for a closing bolt of the door, wherein in particular said rotary catch can be acted upon or is acted upon in particular by a torque, wherein the rotary catch has a closing bearing surface. The door locking device includes a pivoting body, in particular a pivoting locking body, and a lever body, wherein the pivoting body is connected to the lever body by a connecting body, wherein the connecting body is connected by a first joint to the pivoting body and by a second joint to the lever body, wherein in a closed position of the rotary catch the closing bearing surface of the rotary catch is in contact or is able to be brought into contact with the first joint between the pivoting body and the connecting body.

18 Claims, 1 Drawing Sheet

DOOR LOCKING DEVICE, IN PARTICULAR AN ELECTROMAGNETIC DOOR LOCKING DEVICE

BACKGROUND OF INVENTION

Field of Invention

The invention relates to a door locking device, in particular an electromagnetic door locking device, for a door or the like.

Brief Description of Related Art

It is known in the prior art that a rotary catch is used for locking a door or flap or the like, in order to retain the door or the flap in a locked position. The rotary catch in this case has a recess which in the closed position receives a closing bolt or closing clip during the closing movement of the door, wherein for locking in a locked position the rotary catch is pivoted such that the closing bolt or closing clip is blocked in the movement thereof. In order to retain the rotary catch in the locked position, a locking pawl or the like is provided in order to prevent the pivoting of the rotary catch into the unlocked position which releases the closing bolt or closing clip.

An electromagnetic door lock comprising a rotary catch is disclosed, for example, in DE 40 31 077 A1.

Proceeding from this prior art, the object of the invention is to provide a door lock which is of simple construction and cost-effective, wherein in particular it is intended to be possible to design the mechanism of the door lock such that a defined force is able to be introduced into the housing of the door lock.

BRIEF SUMMARY OF THE INVENTION

This object is achieved by a door locking device, in particular an electromagnetic door locking device, for a door with a rotary catch for a closing bolt of the door, wherein in particular said rotary catch can be acted upon or is acted upon in particular by a torque, wherein the rotary catch has a closing bearing surface, with a pivoting body, in particular a pivoting locking body, and with a lever body, wherein the pivoting body is connected to the lever body by means of a connecting body, wherein the connecting body is connected by means of a first joint to the pivoting body and by means of a second joint to the lever body, wherein in the closed position of the rotary catch, the closing bearing surface of the rotary catch is in contact or is able to be brought into contact with the first joint between the pivoting body and the connecting body.

The invention is based on the idea that the door locking device has a locking mechanism, so that in the locked position the rotary catch is prevented from rotating back into the unlocked position. In this case, the locking mechanism has a pivotably mounted pivoting body, in particular a pivoting locking body, a lever body and a connecting body arranged between the pivoting body and the lever body and connected to the pivoting body. In this case, the pivot axis of the pivoting body and the rotational axis of the lever body are arranged and aligned fixedly on, or in, a housing of the door locking device.

By the rotation of the lever body, therefore, when a door is closed, the pivoting body is moved from an unlocked position into a closed position, wherein by means of the pivoting body, in particular the pivoting locking body, the closing bearing surface provided on the outer face of the rotary catch can be brought into contact with the (first) joint between the pivoting body and the connecting body, in the closed position. As a result, the rotary catch can be supported on the pivoting body so that the force which is exerted on the pivoting body is received by the housing. The force acting on the pivoting body is moved by the torque of the rotary catch, wherein this torque is produced, for example, by the external action of force, for example a pulling force on the closing piston or closing bolt. Moreover, a torque may also be produced on the rotary catch by means of a corresponding spring device, so that in the unlocked position the rotary catch is retained or respectively arranged in this position. In particular, the rotary catch has a recess with the closing bearing surface so that in the closed position of the rotary catch the closing bearing surface of the recess is in contact with the first joint between the pivoting body and the connecting body.

Moreover, the door locking device is characterized in that the spacing between the pivot axis of the pivoting body and the pivot point of the first joint is smaller than the lever length of the lever body, in particular is smaller than the spacing between the pivot point of the second joint between the connecting body and the lever body and the rotational axis of the lever body.

Moreover, in one advantageous embodiment of the door locking device it is provided that the spacing between the pivot axis of the pivoting body and the pivot point of the first joint and the spacing between the pivot points of the first joint and the second joint are equal.

Moreover, the pivoting body and the connecting body are advantageously configured as roller chain links. To this end, according to one embodiment of the door locking device it is provided that the pivoting body is configured as an internal link of a roller chain and the connecting body is configured as an external link of a roller chain or that the pivoting body is configured as an external link of a roller chain and the connecting body is configured as an internal link of a roller chain.

Preferably, the lever body and the connecting body are configured as a toggle lever device, wherein in particular the lever length of the lever body is greater than the spacing between the pivot points of the first joint and the second joint on the connecting body.

Moreover, in one development the door locking device is characterized in that in the closed position of the rotary catch the lever body and the connecting body are able to be arranged or are arranged in an over-dead-center position.

Moreover, in the door locking device according to the invention, it is provided that in the closed position of the rotary catch the lever body and/or the connecting body bear against a supporting body, preferably in a housing of the door locking device.

In particular, the door locking device has a housing, the rotary catch, the pivoting body, the connecting body and the lever body being arranged therein. To this end, the housing has an insertion slot so that in the unlocked position a closing bolt or closing clip is inserted into the slot and the jaw-shaped opening of the rotary catch.

In order to move the lever body, an arm body, in particular a lever arm, is advantageously arranged on the lever body. As a result, it is possible to move or respectively to pivot the lever body by actuating the arm body.

To this end, it is further provided that an actuating device is provided for moving the lever body, wherein the actuating device is preferably connected or operatively connected to the arm body connected to the lever body.

In particular, the actuating device has an electric motor or a, preferably bistable, electromagnet.

To this end, it is further provided that for specific control of the movement of the lever body or respectively the pivoting body connected thereto a control device is provided for the actuating device.

According to one advantageous embodiment of the door locking device, it is further provided that the door locking device has a housing, wherein in particular the pivot axis of the rotary catch and/or the pivot axis of the pivoting body and/or the rotational axis of the lever body are mounted or arranged in or on the housing.

Further features of the invention may be derived from the description of embodiments according to the invention together with the claims and the accompanying drawings. Embodiments according to the invention may implement individual features or a combination of a plurality of features.

BRIEF DESCRIPTION OF THE DRAWINGS

The invention is described hereinafter without limiting the general inventive idea by means of exemplary embodiments with reference to the drawings, wherein with regard to all details according to the invention which are not explained in more detail in the text, reference is expressly made to the drawings, in which.

In the drawings, elements and/or parts which are the same or similar are provided in each case with the same reference numerals, so that in each case a further illustration is omitted.

DETAILED DESCRIPTION OF THE INVENTION

Figure 1:
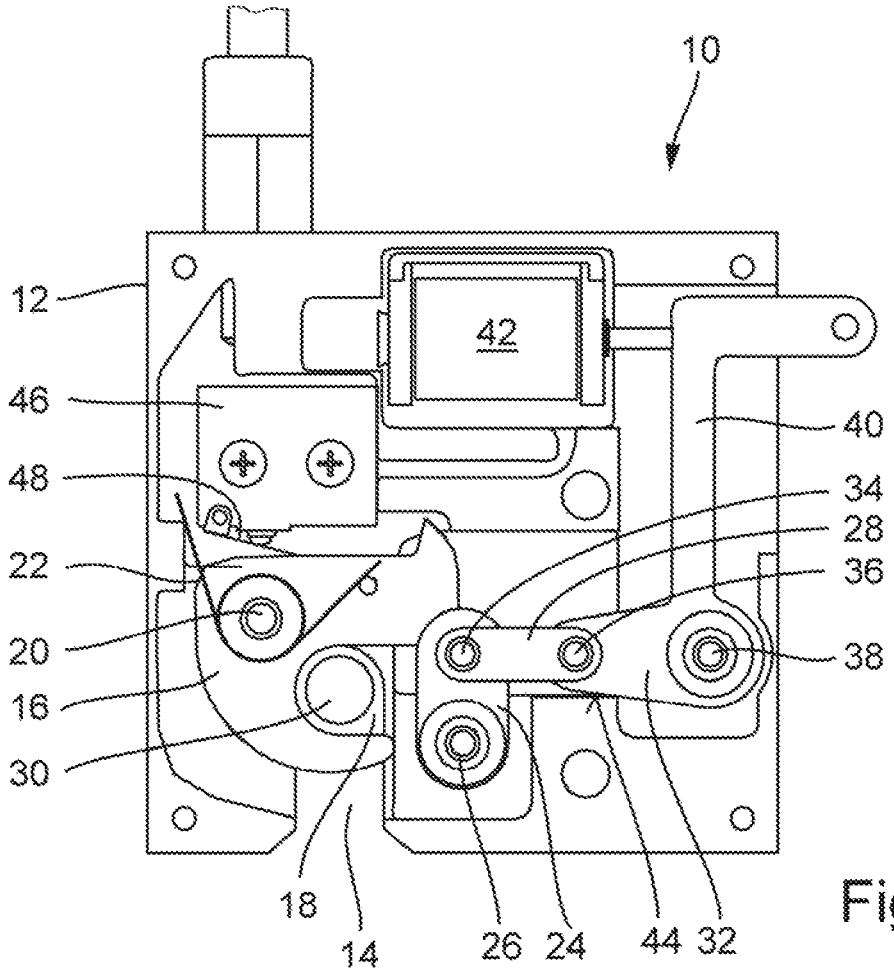
FIG. 1 shows schematically a section through a door locking device in the closed state.

In FIG. 1 a longitudinal section through a door locking device 10 is shown schematically in the closed state. The door locking device 10 has a housing 12. The housing 12 in this case has a housing base plate with a plurality of recesses for the arrangement of the components of the door locking device. The housing 12 has an insertion slot 14, for example a closing bolt 30 of a door or the like being able to be inserted through said insertion slot and being locked in the closed state.

In order to lock the closing bolt 30, a rotary catch 16 is rotatably mounted in the housing 12, said rotary catch having a jaw-shaped recess or opening 18 for receiving the closing bolt 30.

Figure 2:
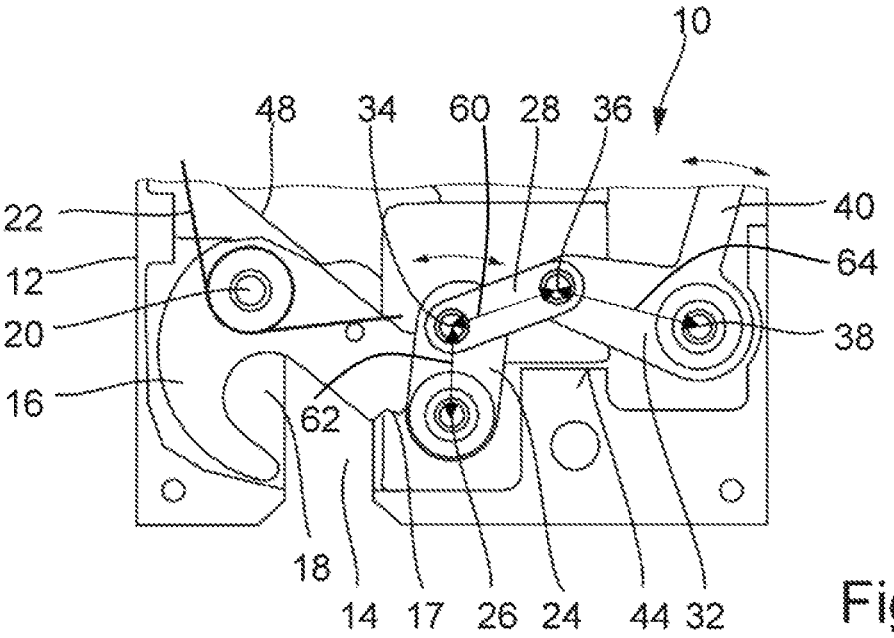
FIG. 2 shows schematically a detail of the door locking device in the unlocked state.

The rotary catch 16 is rotatably mounted by means of a bearing pin 20 in the housing 12, so that the rotary catch 16 can be moved between the closed position (see FIG. 1) and the open position or respectively unlocked position (see FIG. 2). The rotary catch 16 further has a recess with a closing bearing surface 17.

Moreover, a spring 22 is arranged in the housing 12, said spring acting on the rotary catch 16, so that when the rotary catch 16 is opened by means of the spring 22 the rotary catch 16 is automatically rotated into the unlocked position (see FIG. 2).

In the locked position (see FIG. 1) one end of the rotary catch 16 is supported on a pivoting body 24. The pivoting body 24 is pivotable about a bearing pin 26. The pivoting body 24 is connected to a lever body 32 via a connecting body 28. In this case, the pivoting body 24 is connected to the connecting body 28 by means of a (first) joint 34. The connecting body 28 in turn is connected to the lever body 32 via a second joint 36.

In order to rotate the lever body 32, said lever body is rotatably mounted in the housing 12 by means of a bearing pin 38. The bearing pin 26 for the pivoting body 24 and the bearing pin 38 for the lever body 32 in this case are arranged on the housing 12. Moreover, a lever arm 40 is arranged on the lever body 32. For moving or respectively for actuating the lever arm 40 an electromagnet 42 is provided with a moveable tappet, wherein the tappet of the electromagnet 42 is brought into contact with the lever arm 40. In one embodiment, the lever arm 40 is connected to an electromagnet 42.

In the closed position of the rotary catch 16 (see FIG. 1) the lever body 32 and the connecting body 28 are arranged in an over-dead-center position (i.e., pivot points of the bearing axis of the lever body and of the first and second joint on the connecting body are aligned), wherein the lever body 32 in this case is supported on a supporting body 44 of the housing 12. When actuating the electromagnet 42 the lever arm 40 is forced away from the electromagnet 42, so that the lever body 32 connected to the lever arm 40 is rotated or respectively moved away from the supporting body 44 and deflected so that the dead center point of the toggle lever between the connecting body 28 and the lever body 32 is passed through, whereby the pivoting body 24 connected to the connecting body 28 is moved away from the rotary catch 16 and, as a result, the rotary catch 16 is opened (see FIG. 2). By the deflection of the pivoting body 24, the closing bearing surface 17 of the rotary catch 16 no longer bears against the first joint 34, whereby the rotary catch 16 is released.

According to the invention, in one embodiment the pivoting body 24 is configured as an internal link of a roller chain and the connecting body 28 is configured as an external link of a roller chain. Moreover, in one embodiment the spacing 62 of the pivot axis 26 from the rotational axis of the joint 34 is not equal to the spacing 60 between the rotational axes of the joints 34, 36. Moreover, the lever length 64 of the lever body 32, i.e. the spacing between the pivot axis on the bearing pin 26 and the pivot point or respectively the rotational axis of the second joint 36, is greater than the spacing 60 between the rotational axes of the joints 34, 36.

In the locked position or respectively in the closed position the closing bearing surface 17 of the rotary catch 16 bears against the first joint 34 between the pivoting body 24 and the connecting body 28. When the lever body 32 is moved from the closed position, the bearing of the closing bearing surface 17 of the rotary catch 16 on the joint 34 is released and the rotary catch 16 is released, whereby the rotary catch 16 is rotated into the unlocked position in which the closing bearing surface 17 of the rotary catch 16 does not contact the first joint 34 between the pivoting body 24 and the connecting body 28 (see FIG. 2). In the unlocked position, the closing bolt 30 is released or received again for locking.

Moreover, a switch 46 with a control device (not shown here) is arranged in the housing 12 (see FIG. 1), a sensor arm 48 being pivotably arranged thereon. The pivoting body 24 bears with its free end on the outer face of the rotary catch 16, wherein depending on the rotary position of the rotary catch 16 it is detected by means of the sensor arm 48 whether the rotary catch 16 is in the closed position or in the unlocked position.

In order to control the electromagnet 42, for opening the closed position of the rotary catch 16 (see FIG. 1) a control signal is emitted from the control device to the electromagnet 42, whereby the lever arm 40 and the lever body 32 connected thereto are rotated.

All of the cited features and the features to be derived only from the drawings and also individual features, which are disclosed in combination with other features, are regarded as essential to the invention individually and in combination. Embodiments according to the invention may be implemented by individual features or a combination of a plurality of features. Within the scope of the invention features which are identified by "in particular" or "preferably" are to be understood as optional features.

LIST OF REFERENCE NUMERALS

10 door locking device
12 housing
14 insertion slot
16 rotary catch
17 closing bearing surface
18 jaw-shaped opening
20 bearing pin
22 spring
24 pivoting body
26 bearing pin
28 connecting body
30 closing bolt
32 lever body
34 first joint
36 second joint
38 bearing pin
40 lever arm
42 electromagnet
44 supporting body
46 switch
48 sensor arm
60 spacing between rotational axes of joints 34, 36
62 spacing between rotational axes of bearing pin 26 and joint 34
64 lever length

What is claimed is:

1. A door locking device for a door having a closing bolt, the door locking device comprising:
a rotary catch for the closing bolt of the door;
a pivoting body;
a connecting body; and
a lever body; and
wherein the rotary catch is configured to be acted upon by a torque,
wherein the rotary catch includes a recess with a closing bearing surface,
wherein the connecting body is connected by a first joint to the pivoting body and by a second joint to the lever body,
wherein, in a closed position of the rotary catch, the closing bearing surface of the recess of the rotary catch directly contacts the first joint between the pivoting body and the connecting body, and
wherein, in an open position of the rotary catch, the closing bearing surface of the recess of the rotary catch does not directly contact the first joint between the pivoting body and the connecting body.

2. The door locking device according to claim 1, wherein spacing between a pivot axis of the pivoting body and a pivot point of the first joint is smaller than a lever length of the lever body.

3. The door locking device according to claim 2, wherein spacing between the pivot axis of the pivoting body and the pivot point of the first joint is smaller than spacing between a pivot point of the second joint between the connecting body and the lever body and a rotational axis of the lever body.

4. The door locking device according to claim 1, wherein spacing between a pivot axis of the pivoting body and a pivot point of the first joint and spacing between pivot points of the first joint and the second joint are not equal.

5. The door locking device according to claim 4, wherein the pivoting body is configured as an internal link of a roller chain and the connecting body is configured as an external link of a roller chain, or wherein the pivoting body is configured as an external link of a roller chain and the connecting body is configured as an internal link of a roller chain.

6. The door locking device according to claim 1, wherein the pivoting body and the connecting body are configured as roller chain links.

7. The door locking device according to claim 1, wherein the lever body and the connecting body are configured as a toggle lever device.

8. The door locking device according to claim 7, wherein a lever length of the lever body is greater than spacing between pivot points of the first joint and the second joint on the connecting body.

9. The door locking device according to claim 1, wherein, in the closed position of the rotary catch, pivot points of the bearing axis of the lever body and of the first and second joint on the connecting body are aligned.

10. The door locking device according to claim 1, wherein in the closed position of the rotary catch the lever body and/or the connecting body bear against a supporting body.

11. The door locking device according to claim 10, wherein the supporting body is in a housing of the door locking device.

12. The door locking device according to claim 1, wherein an arm body is arranged on the lever body.

13. The door locking device according to claim 12, wherein the arm body is a lever arm.

14. The door locking device according to claim 1, wherein an actuating device is provided for moving the lever body.

15. The door locking device according to claim 14, wherein the actuating device has an electric motor or an electromagnet.

16. The door locking device according to claim 14, wherein a control device is provided for the actuating device.

17. The door locking device according to claim 1, wherein the door locking device has a housing.

18. The door locking device according to claim 17, wherein a pivot axis of the rotary catch and/or a pivot axis of the pivoting body and/or a rotational axis of the lever body are mounted in or on the housing.

* * * * *